US009303585B2

(12) United States Patent
Stross et al.

(10) Patent No.: US 9,303,585 B2
(45) Date of Patent: Apr. 5, 2016

(54) HOUSING WITH A BORE FOR AN INTERNAL COMBUSTION ENGINE

(71) Applicant: Bayerische Motoren Werke Aktiengesellschaft, Munich (DE)

(72) Inventors: Ludwig Stross, Aschach/Steyr (AT); Thomas Huber, Kronstorf (AT)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/489,709

(22) Filed: Sep. 18, 2014

(65) Prior Publication Data

US 2015/0000628 A1 Jan. 1, 2015

Related U.S. Application Data

(63) Continuation of application No. PCT/EP2013/055220, filed on Mar. 14, 2013.

(30) Foreign Application Priority Data

Mar. 21, 2012 (DE) ..... 10 2012 204 483

(51) Int. Cl.

| | |
|---|---|
| ***F02B 75/22*** | (2006.01) |
| ***F02F 7/00*** | (2006.01) |
| ***B24B 33/02*** | (2006.01) |

(Continued)

(52) U.S. Cl.

CPC ..... *F02F 7/0021* (2013.01); *B24B 33/02* (2013.01); *F02B 2075/025* (2013.01); *F02F 1/24* (2013.01); *F02F 7/0007* (2013.01); *F02F 7/0012* (2013.01); *F02F 7/0053* (2013.01); *F05C 2201/021* (2013.01)

(58) Field of Classification Search

CPC ..... F02F 7/0053; F02F 7/0007; F02F 7/0012; F02B 2075/025

USPC ..... 123/195 R

See application file for complete search history.

(56) References Cited

U.S. PATENT DOCUMENTS

| | | | | |
|---|---|---|---|---|
| 5,195,480 | A * | 3/1993 | Hudson | 123/195 R |
| 6,287,057 | B1 | 9/2001 | Kurz | |
| 8,459,290 | B2 | 6/2013 | Minami et al. | |

FOREIGN PATENT DOCUMENTS

| | | | |
|---|---|---|---|
| DE | 11 31 945 | | 6/1962 |
| DE | 42 14 505 | A1 | 11/1993 |
| DE | 198 30 903 | A1 | 1/2000 |

(Continued)

OTHER PUBLICATIONS

Corresponding International Search Report dated Jun. 6, 2013 with English Translation (four (4) pages).

(Continued)

*Primary Examiner* — Lindsay Low
*Assistant Examiner* — Charles Brauch
(74) *Attorney, Agent, or Firm* — Crowell & Moring LLP

(57) ABSTRACT

A housing for an internal combustion engine is provided with a bore, which is formed by at least two bore sections at a distance from each other. The bore may be a bearing tunnel in a crankcase or a cylinder head of the internal combustion engine. A rotating, machining tool is provided to machine the bore. The tool is introduced into the bore by axial displacement and the bore is used as a counter-bearing for the tool for radially supporting the tool. The counter-bearing is in one piece with the housing.

14 Claims, 1 Drawing Sheet

(51) Int. Cl.
*F02B 75/02* (2006.01)
*F02F 1/24* (2006.01)

(56) References Cited

FOREIGN PATENT DOCUMENTS

DE 10 2009 051 285 A1 9/2010
DE 10 2010 006 188 A1 8/2011
DE 10 2010 010 901 A1 9/2011
EP 1 050 677 A2 11/2000

OTHER PUBLICATIONS

German Search Report dated Jan. 18, 2013 with English Translation (ten (10) pages).

* cited by examiner

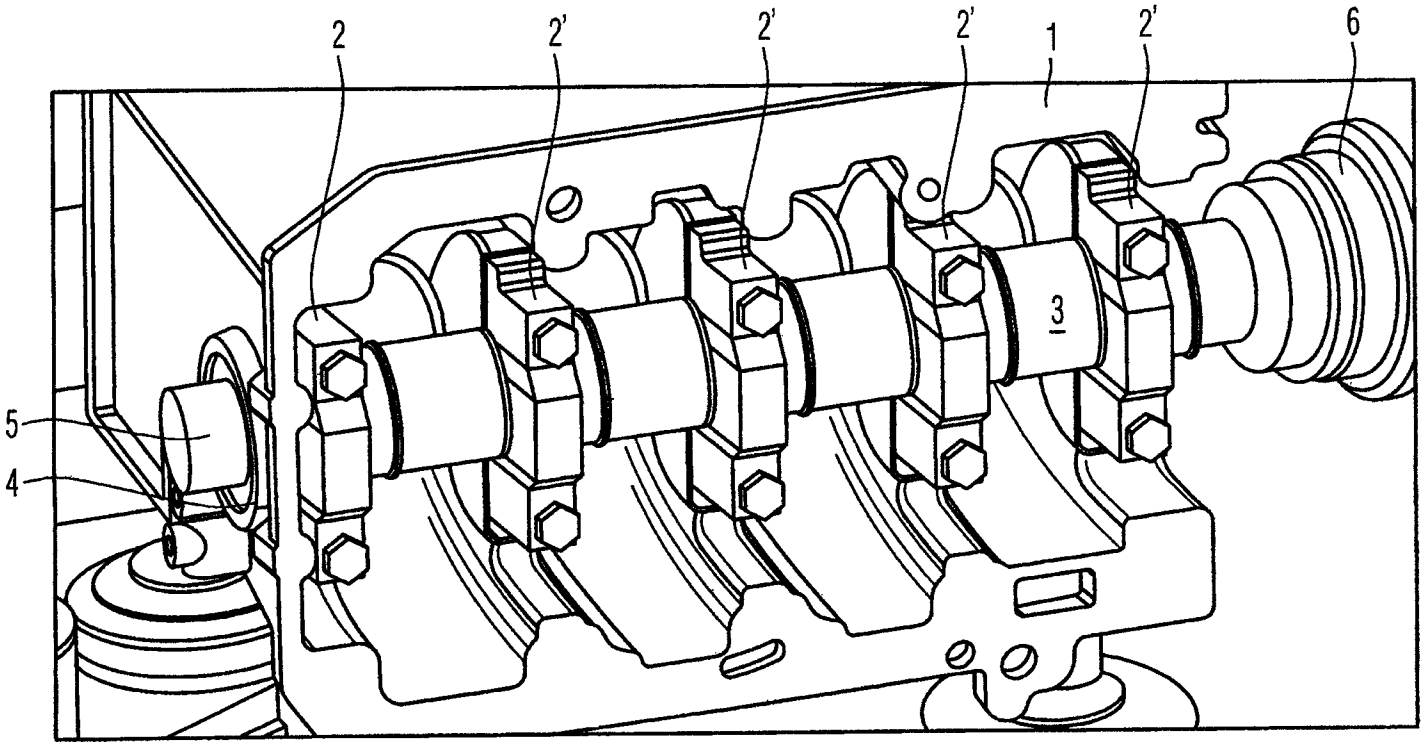
6
2'
1
3
2'
2'
2'
2
5
4

HOUSING WITH A BORE FOR AN INTERNAL COMBUSTION ENGINE

CROSS REFERENCE TO RELATED APPLICATIONS

This application is a continuation of PCT International Application No. PCT/EP2013/055220, filed Mar. 14, 2013, which claims priority under 35 U.S.C. §119 from German Patent Application No. 10 2012 204 483.3, filed Mar. 21, 2012, the entire disclosures of which are herein expressly incorporated by reference.

BACKGROUND AND SUMMARY OF THE INVENTION

The invention relates to a housing with a bore for an internal-combustion engine. The bore is formed of at least two mutually spaced bore sections and, in particular, is a bearing tunnel in a crankcase or a cylinder head of the internal-combustion engine.

Concerning the technical environment, reference is made, for example, to German Published Patent Application DE 10 2010 006 188 A1. From DE 10 2010 006 188 A1, a grinding system and a process for manufacturing a crankcase are known. The grinding system is suitable for the machining of a plurality of crankshaft bearing bores for roller bearings of a crankshaft mounted in the crankcase. In this case, the grinding system has a rotatorily drivable tool shaft, which carries a plurality of machining units arranged in a mutually axially spaced manner, whose number corresponds to the number of crankshaft bearing bores present at the crankcase. Each machining unit arranged on the tool shaft has at least one grinding wheel. An axial distance between the grinding wheels of two adjacent machining units corresponds to a distance between two adjacent crankshaft bearing bores. So that a cylindrical grinding precision is achieved that is as high as possible, the grinding tool is supported by a separate counterbearing on the side of the housing facing away from the drive of the tool.

Furthermore, from German Published Patent Application DE 10 2009 051 285 A1, a process and a honing tool for manufacturing at least one bearing bore, as well as an internal-combustion engine having at least one honed bearing bore, are known. Among others, a process is also disclosed for manufacturing at least one bearing bore in the internal-combustion engine, particularly for a crankshaft or a camshaft, by means of a honing tool, which is moved parallel to a bore axis of the bearing bore axially and rotating about a tool axis. It is suggested to produce, in a non-loaded state of the bearing bore, by form-honing the interior surface of the bearing bore, a starting shape of the bearing bore which is asymmetrical in such a fashion that, in an operating state, the bearing bore has a symmetrical operating shape that deviates from the initial shape. Furthermore, a honing tool is disclosed for producing at least one bearing bore. In order to achieve the best-possible surface quality, the honing tool is also disposed on a counterbearing on its side facing away from the tool drive, which counterbearing is arranged outside the internal-combustion engine.

Furthermore, from German Published Patent Application DE 10 2010 010 901 A1, on which the present invention is based, a process and a system are known for finish-machining a crankshaft bearing bore. In the process for finish-machining, particularly for finish-machining a crankshaft bearing bore in a cylinder crankcase of an internal-combustion engine, starting from a prepared bore, a finish-machined bore is produced which has a defined finished size, a defined desired structure of the interior bore surface and a defined position of the bore axis. The process is characterized by at least one power honing operation in which, while a honing tool is used, by honing the bore, a removal of material of at least 0.5 mm is generated relative to the diameter of the bore. The power honing operation is carried out as an axial-position-correcting honing operation such that, as a result of the power honing operation, a displacement of the bore axis takes place in the direction of the desired position. In order to achieve a quality of the honed surface that is as high as possible, a workpiece mounting device is provided for the workpiece and, in addition, a counterbearing is provided on the side of the workpiece mounting device facing away from the honing spindle, for the rotatable bearing of the honing tool, in which case the counterbearing can preferably be moved along with the honing tool during the lifting movement of the honing tool, i.e., its position can be changed in the axial direction.

Even if the above-mentioned systems and processes have no significant disadvantages, it is desirable to reduce the space requirement for a machining of a housing according to the above-mentioned type.

This and other objects are achieved by providing a housing for an internal combustion engine, the housing having a bore formed of at least two mutually spaced bore sections. The bore, in particular, is a bearing tunnel in a crankcase or a cylinder head of the internal-combustion engine. For machining the bore, a rotating cutting tool is provided which, on one side, can be inserted in the bore by axial displacement and, on the other side of the bore, is radially supported by a counterbearing for the tool. The counterbearing is in one piece with the housing.

According to the invention, by way of the counterbearing, which is in one piece with the crankcase—a guide bore, as it were—, the tool can be guided for the machining of the bore in the housing, for example, a crankshaft bearing bore. Thus, a swerving of the tool that differs over the service life of the tool, for example, as a result of different materials, will also no longer be possible. Advantageously, the cycle time of the machining can be reduced by up to 25%, while the concentricity of the finished bore is excellent.

According to a further development, the counterbearing is connected with the housing in a force-locking or form-fitting and/or bonded manner. This may take place, for example, in that the counterbearing is produced together with the housing in one casting process. In other embodiments, it may, for example, also be screwed on, welded on, or soldered on.

In a further embodiment, the counterbearing is an extension of, particularly, a crankshaft bearing.

Particularly preferably, the counterbearing is used as a bore for a radial shaft sealing ring. This provides best-possible concentricity between the bearing and the radial shaft sealing ring, which has a positive effect on the permanent tightness.

According to a still further development, the inside diameter of the counterbearing is smaller than the bore diameter of the bore sections.

The process according to the invention can be used not only for a crankshaft bearing tunnel but also, for example, for a camshaft bearing tunnel and/or an eccentric shaft bearing tunnel.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 is a perspective cut-away view of a housing for an internal-combustion engine according to an embodiment of the invention having a bore.

DETAILED DESCRIPTION OF THE DRAWING

FIG. 1 is view of a housing 1 for an internal-combustion engine. The housing 1 has a bore which, in the present embodiment, is formed of five mutually spaced bore sections 2, 2'. In the present embodiment, the housing 1 is, for example, a crankcase with five bore sections 2, 2' formed by crankshaft bearings. The view of FIG. 1 into the crankcase takes place from below onto the crankshaft bearing tunnel of the crankshaft, the oil sump, which would obstruct the view of the crankshaft bearing tunnel, not being shown. In a further embodiment, the housing 1 may also be a cylinder head. According to the invention, it is also contemplated to machine bearing bores for balance shafts in a crankcase or bearing bores for camshafts and/or eccentric shafts in a cylinder head.

For the finish-machining of the bore, a rod-shaped, rotating and cutting tool 3 is provided which, on one side of the housing 1 can be inserted by an axial displacement into the bore formed of bore sections 2, 2". The cutting tool 3 may, for example, be a fine-boring tool, a grinding tool or a honing tool. For the machining of the individual bore sections 2, 2', the tool 3 has a separate (unnumbered) cutting edge area for each bore section 2, 2', which cutting edge area is situated in the illustrated position in one crankshaft bearing, respectively.

So that, during the finish-machining of the crankshaft bearing tunnel, the tool is held with as few vibrations as possible for an optimal surface quality, on the side of the bore facing away from a drive 6 of the tool 3, a counterbearing 4 for the tool is provided, for the radial support of the tool 3. The counterbearing 4 is constructed in one piece with the housing 1. As a result of this measure, a separate counterbearing arranged outside the housing 1, as known from the above-cited state of the art, is not necessary, whereby the machining machine together with the tool clearly becomes shorter and takes up less space.

The tool 3 illustrated in FIG. 1 further has a guide pin 5 on the side situated opposite the drive 6, which guide pin 5 is used for guiding the tool 3 in the counterbearing 4. In the present embodiment, the counterbearing 4 is produced in one piece with the housing in a casting operation. In further embodiments, the counterbearing 4 may also be connected with the housing in a force- or form-fitting manner. The counterbearing may, for example, be screwed on and be removed after the finish-machining, or it may be fixed by welding or soldering.

The counterbearing 4 preferably is an extension of a bore section 2, 2', which, in the present embodiment, is a crankshaft bearing. This further development again reduces the manufacturing costs.

In a further embodiment, the counterbearing 4 can also be used as a bore for a radial shaft sealing ring. This has the advantage that the concentricity between the radial shaft sealing ring and the crankshaft axis is very exact, so that the greatest possible permanent tightness of the radial shaft sealing ring is ensured.

Preferably, the inside diameter of the counterbearing 4 is smaller than a bore diameter of the bore sections 2, 2'.

The mounting of a guiding possibility is suggested in the housing 1 for the tool 3, for machining the crankshaft bearing tunnel with a defined guidance of the tool 3. As a result of the further development of the invention, a separate counterbearing 4 situated outside the housing 1 is not necessary. In the counterbearing 4, which is in one piece with the crankcase, the tool 3 can be guided for the machining of the bore in the housing 1. Thus, a swerving of the tool 3, that differs over the service life of the tool 3, for example, as a result of different materials, is no longer possible. Advantageously, the cycle time of the machining can be reduced by up to 25%, while the concentricity of the finished bore is excellent.

LIST OF REFERENCE NUMBERS

1 Housing
2,2' Bore section
3 Tool
4 Counterbearing
5 Guide pin
6 Drive The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A housing for an internal-combustion engine, comprising:

a bore of the housing, the bore being formed of at least two bore sections arranged at a distance from each other in the housing and, providing a bearing tunnel; and a counterbearing in one-piece with the housing, the counterbearing being configured at one side of the housing to radially support a rotating machining tool axially inserted into the bore from an opposite side of the housing, wherein the counterbearing is axially and radially separated from a fastening portion that fastens a crankshaft to the housing.

2. The housing according to claim 1, wherein the counterbearing is force-fittedly connected with the housing.

3. The housing according to claim 1, wherein the counterbearing is form-fittingly connected with the housing.

4. The housing according to claim 1, wherein the counterbearing is bonded with the housing.

5. The housing according to claim 1, wherein the counterbearing is cast together with the housing.

6. The housing according to claim 1, wherein the counterbearing is an extension of one of the at least two bore sections.

7. The housing according to claim 1, wherein the counterbearing is configured as a bore for a radial shaft seal ring.

8. The housing according to claim 7, wherein the counterbearing has an inside diameter that is smaller than a bore diameter of the at least two bore sections.

9. The housing according to claim 6, wherein the counterbearing has an inside diameter that is smaller than a bore diameter of the at least two bore sections.

10. The housing according to claim 6, wherein the bore sections are configured to form one of a crankshaft bearing tunnel, a camshaft bearing tunnel, or an eccentric shaft bearing tunnel.

11. The housing according to claim 8, wherein the bore sections are configured to form one of a crankshaft bearing tunnel, a camshaft bearing tunnel, or an eccentric shaft bearing tunnel.

12. The apparatus according to claim 9, wherein the bore sections are configured to form one of a crankshaft bearing tunnel, a camshaft bearing tunnel, or an eccentric shaft bearing tunnel.

13. A method of machining a bore in a housing of an internal combustion engine, the bore being formed of at least two mutually spaced bore sections of the housing forming a bearing tunnel, the method comprising the acts of:

inserting a rotating machining tool into the bore from one side of the housing via an axial displacement of the machining tool;

radially supporting the machining tool in a counterbearing that is formed in one piece with the housing at an opposite side of the housing; and machining the at least two bore sections via the rotating machining tool while the rotating machining tool is radially supported in the counterbearing, wherein the counterbearing is axially and radially separated from a fastening portion that fastens a crankshaft to the housing.

14. A housing for an internal-combustion engine, comprising:

a bore of the housing, the bore being formed of at least two separate circular bore sections in the housing, the two separate bore sections defining a bearing tunnel; and a counterbearing that is formed in one-piece with the housing, the counterbearing being configured on one side of the housing to radially support a cylindrical rotating machining tool that is axially inserted into the bore from an opposite side of the housing, wherein the counterbearing is axially and radially separated from a fastening portion that fastens a crankshaft to the housing.

* * * * *